US008998578B2

(12) United States Patent
Rauch et al.

(10) Patent No.: US 8,998,578 B2
(45) Date of Patent: Apr. 7, 2015

(54) METHOD AND DEVICE FOR ADJUSTING THE ROTOR POSITION IN A GAS TURBINE OR STEAM TURBINE

(75) Inventors: Marc Rauch, Regensdorf (CH); Peter Baldischweiler, Schneisingen (CH); Paul Kammhuber, Oetwil an der Limmat (CH)

(73) Assignee: Alstom Technology Ltd, Baden (CH)

( * ) Notice: Subject to any disclaimer, the term of this patent is extended or adjusted under 35 U.S.C. 154(b) by 775 days.

(21) Appl. No.: 13/179,819

(22) Filed: Jul. 11, 2011

(65) Prior Publication Data

US 2012/0039709 A1 Feb. 16, 2012

(30) Foreign Application Priority Data

Jul. 13, 2010 (CH) ..... 1138/10

(51) Int. Cl.
*F01D 25/24* (2006.01)
*F01D 25/16* (2006.01)
*F01D 25/30* (2006.01)

(52) U.S. Cl.
CPC ..... *F01D 25/243* (2013.01); *F01D 25/162* (2013.01); *F01D 25/30* (2013.01); *F05D 2230/64* (2013.01); *F05D 2230/644* (2013.01)

(58) Field of Classification Search
USPC ..... 415/108, 156, 182.1, 213.1, 214.1
See application file for complete search history.

(56) References Cited

U.S. PATENT DOCUMENTS

| | | | | |
|---|---|---|---|---|
| 3,754,833 | A * | 8/1973 | Remberg | 415/108 |
| 4,222,708 | A * | 9/1980 | Davison | 415/127 |
| 4,734,009 | A | 3/1988 | Campbell et al. | |
| 5,402,631 | A * | 4/1995 | Wulf | 60/783 |
| 5,634,327 | A | 6/1997 | Kamber et al. | |
| 6,309,177 | B1 * | 10/2001 | Swiderski et al. | 415/173.2 |
| 7,329,098 | B2 * | 2/2008 | Burdgick | 415/213.1 |
| 7,419,355 | B2 * | 9/2008 | Burdgick | 415/213.1 |
| 8,142,150 | B2 * | 3/2012 | Frick et al. | 415/214.1 |
| 8,210,809 | B2 * | 7/2012 | Delobel et al. | 415/214.1 |
| 8,690,533 | B2 * | 4/2014 | Burdgick et al. | 415/213.1 |
| 2012/0039709 | A1 * | 2/2012 | Rauch et al. | 415/213.1 |
| 2013/0081404 | A1 * | 4/2013 | Baldischweiler et al. | 60/796 |

FOREIGN PATENT DOCUMENTS

| | | | | |
|---|---|---|---|---|
| CH | 639171 | A5 * | 10/1983 | F01D 11/02 |
| DE | 2619929 | A1 | 11/1976 | |
| EP | 0251125 | A1 | 1/1988 | |
| EP | 0620363 | A1 | 10/1994 | |
| EP | 0718470 | A2 | 6/1996 | |
| WO | 0075492 | A1 | 12/2000 | |

OTHER PUBLICATIONS

Machine translation of DE2619929 from Espacenet.*

* cited by examiner

*Primary Examiner* — Edward Look
*Assistant Examiner* — Christopher R Legendre
(74) *Attorney, Agent, or Firm* — Buchanan Ingersoll & Rooney PC

(57) ABSTRACT

A method is provided for adjusting the position of a rotor of a turbine. The turbine includes a first casing and a second casing. The second casing, in a bearing region of the rotor, has a fixed relative position, with regard to a rotor end, and is screwed to the first casing via a threaded connection. The method includes releasing the threaded connection; adjusting the relative position of the rotor to the first casing, which encloses the rotor in the flow region, by the relative position of the second casing to the first casing being adjusted; and refastening the threaded connection. Furthermore, a gas turbine or a steam turbine with such a device for adjusting the relative position of rotor and casing is also described.

12 Claims, 3 Drawing Sheets

METHOD AND DEVICE FOR ADJUSTING THE ROTOR POSITION IN A GAS TURBINE OR STEAM TURBINE

FIELD OF THE INVENTION

The present invention refers to a method for adjusting the rotor position in a gas turbine or steam turbine, and also to a device for adjusting the rotor position in a gas turbine or steam turbine, and to a gas turbine/steam turbine with such a device.

BACKGROUND

An accurate adjustment of the relative position of the rotor, including rotating elements which are arranged thereupon, relative to the stationary elements (casings, etc.) in a gas turbine or steam turbine is vital for an optimum, trouble-free operation and low maintenance intervals. Inaccurate positioning leads to differences in the flow behavior around the circumference, therefore leads to vortices, locally increased temperatures, etc. Furthermore, inaccurate positioning can lead to an eccentric rotor position and to a severe rubbing of the blades on the casing and consequently to damage to the blading.

Positioning and adjustment of the radial position of the rotor has been carried out up to now by displacement of the journal bearing of the rotor. Displacement in the vertical and horizontal directions is achieved by exchanging shims of such a bearing. Positioning accuracy with this method lies within the region of 0.05 mm.

The problem with this procedure is, inter alia, that the journal bearings, integrated into compressor inlet casing and exhaust gas casing, are not easily accessible from the outside. For adjusting the journal bearing, the gas turbine or steam turbine has to be at least partially opened up in a very time-consuming procedure. Based on experience, 6 shifts of 12 hours are required for such an adjustment of the compressor bearing.

After displacement of the journal bearings in the compressor inlet casing, moreover, all the oil scrapers and the coupling alignment have to be adjusted. The time consumption for this is typically about 6 shifts.

The total time consumption for adjustment is correspondingly within the region of about 12 shifts, which amounts to an enormous downtime with corresponding costs.

SUMMARY

The present disclosure is directed to a method for adjusting the position of a rotor of a turbine. The turbine includes a first casing and a second casing. The second casing, in a bearing region of the rotor, has a fixed relative position, with regard to a rotor end, and is screwed to the first casing via a threaded connection. The method includes releasing the threaded connection; adjusting the relative position of the rotor to the first casing, which encloses the rotor in the flow region, by the relative position of the second casing to the first casing being adjusted; and refastening the threaded connection.

The present disclosure is also directed to a turbine, including a rotor, which is arranged in a first casing, having a rotor end which is supported in a region of a second casing. The first casing is fastened on the second casing via a threaded connection. In a fastening region of the casings first wedge elements are provided, which fix the position of the first casing in a vertical direction relative to the second casing and allow the position of the first casing to be displaced in a horizontal direction when the threaded connection of the two casings is in a released state.

BRIEF DESCRIPTION OF THE DRAWINGS

Preferred embodiments of the invention are described in the following text with reference to the drawings which serve purely for explanation and are not to be construed as being limiting. In the drawings.

DESCRIPTION OF PREFERRED EMBODIMENTS

Introduction to the Embodiments

Figure 1A:
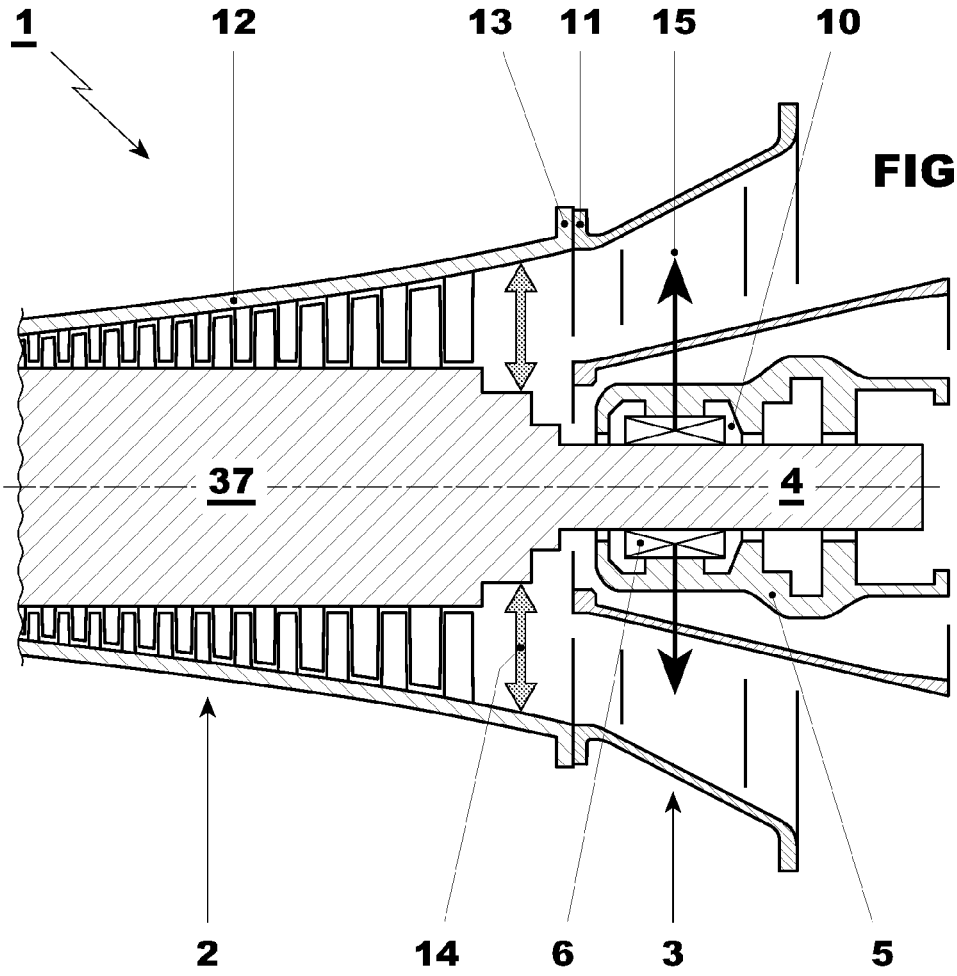
FIG. 1*a*) shows an axial section through the compressor inlet region of a gas turbine.

Accordingly, the present invention refers to an improved method for adjusting the position of a rotor of a gas turbine or a steam turbine relative to the casing which encloses this rotor in the flow region. Furthermore, the present invention refers to a gas turbine or a steam turbine which has corresponding devices in order to implement such a method.

According to the method, the relative position of the rotor to the first casing which encloses the rotor in the flow region is adjusted by the threaded connection, with which the first casing is fastened to the elements supporting the rotor, being released in a first step. In the case of the latter, it typically concerns a second casing in the bearing region of the rotor, the second casing has a fixed relative position with regard to the rotor end and is screwed to the first casing.

After releasing the threaded connection, the relative position of this second casing relative to the first casing is now adjusted. This adjustment is carried out for example via first wedge elements, wherein these first wedge elements fix the position of the first casing in the vertical direction relative to the second casing, and allow the position to move in the horizontal direction.

Then, if necessary after an additional fixing of the position in the horizontal direction, the threaded connection is refastened and therefore fixes the first casing on the second casing.

In contrast to the prior art, the relative position of the rotor in the flow region of the hot gases or of the compression air, or of the steam, is therefore not adjusted by the bearing of the rotor being aligned but rather by only the casing section which actually encloses the rotor in the flow region being simply brought into the correct position relative to the rotor. Typically, it is sufficient to bring only casing sections which enclose the bladed part of the rotor into the correct position relative to the rotor. In this way, all adjustment measures which are necessary in the method according to the prior art are superfluous because the rotor is brought into another position. Moreover, access to the fastening of the first casing on the second casing is much better and such measures with significantly lower time consumption can be realized accordingly.

The adjustment of the radial rotor position is carried out therefore typically by a displacement on the radial flange of the second casing. The positioning is ensured by adjustable wedges and shim plates which encompass them. Consequently, a reduction of the required time by about 3 shifts results. Moreover, higher accuracy of adjustment is made possible.

Typically in the case of a gas turbine, the first casing is the compressor casing and the second casing is the compressor inlet casing.

According to a first preferred embodiment, for adjusting the position in the vertical direction, after releasing the threaded connection, the first casing is positioned using a hydraulic tool, and shim plates, which are provided on the upper side and lower side of the first wedge elements, are exchanged. Since such shim plates can be very thin in their selection, and, moreover, arranged at very easily accessible places of the machine, a very accurate orientation is possible.

The aforesaid wedge elements are typically laterally arranged on both sides of the casing, that is to say approximately at the 3 o'clock and 6 o'clock positions with regard to the rotational direction of the turbine. As a result of the corresponding arrangement of the shim plates, by these wedge elements the vertical position, in other words the height of the first casing (relative to the rotor), is therefore adjusted. The lateral position, that is to say positioning in a horizontal displacement direction, is not normally fixed by means of these wedge elements, the casing being able to move on the wedges in this direction. For fixing in the horizontal displacement direction, according to a further preferred embodiment, a further similar wedge element can be arranged either at the top or bottom (or both), in its turn fixing the lateral position but not the horizontal.

Accordingly, in a method according to a preferred embodiment, at least one second wedge element is arranged, wherein this second wedge element fixes the position of the first casing in the horizontal direction relative to the second casing (typically again via the exchange of shim plates), and allows the position to move in the horizontal direction (that is to say upwards and downwards). In this case also, for adjusting the position in the horizontal direction, after releasing the threaded connection, the first casing is preferably positioned using a hydraulic tool, and shim plates, which are provided on the lateral sides of the second wedge element, are exchanged. The positioning can first of all be carried out in the vertical direction and then in the horizontal direction, or vice versa.

Furthermore, the present invention refers to a turbine, especially a gas turbine or steam turbine, which enables implementation of the method which is described above. Such a turbine specifically has a rotor which is arranged in a first casing and is supported in the region of a second casing (or bearing support), wherein the first casing is fastened on the second casing. In such a turbine, provision is made in the fastening region of the casings for first wedge elements which fix the position of the first casing in the vertical direction relative to the second casing, and allow the position to move in the horizontal direction, providing the threaded connection of the two casings is in the released state.

In such turbines, the first casing typically has a radially outwardly oriented first flange (or flange section), and the second casing has a radially outwardly oriented second, virtually opposite flange. In this case, the first casing is fastened on the second casing via these flanges.

Normally, the rotor is supported on both sides and there are two such second casings. A further, different casing (turbine casing, for example) can also lie on the second opposite side, in which case adjustment can also be carried out via such wedges at this interface point. According to the invention, the first flange and also the second flange preferably have axially aligning recesses, normally at the 9 o'clock and 3 o'clock positions with regard to the rotational direction of the rotor, and the wedge elements are arranged in these recesses and bridge these in the axial direction.

The first wedge elements in this case are preferably designed in the form of blocks or bars with rectangular or square cross section with a first section and a second section.

Now, either the first section is fastened in the recess of the first flange, and the second section, which has horizontally running upper sides and lower sides, projects into the recess of the second flange and is arranged with a vertical clearance in said recess of the second flange. This clearance is bridged in this case via horizontal shim plates.

Alternatively, virtually in the reverse situation, the first section is fastened in the recess of the second flange, and the second section has horizontally running upper sides and lower sides, and projects with vertical clearance into the recess of the first flange, this clearance being bridged via horizontal shim plates.

In this case also, provision can preferably again be made for at least one second wedge element which fixes the position of the first casing in the horizontal direction relative to the second casing, and allows the position to move in the vertical direction, providing the threaded connection of the two casings is in the released state. This second wedge element is preferably arranged at the 12 o'clock and/or 6 o'clock positions with regard to the rotational direction of the rotor.

The second section of the first wedge elements can have at least one horizontal threaded hole, which runs radially with regard to the turbine axis, so that the relative position of the first casing to the second casing can be adjusted via an adjusting screw which is screwed into this threaded hole. If, for example, adjustment is carried out in the vertical direction with the aid of the wedge elements and shim plates, adjustment in the horizontal direction is carried out by this adjusting screw.

The first wedge element and/or the second wedge element typically have a length in the axial direction which lies at least within the range of the overall thickness of the two flanges, that is to say bridges these and, if necessary, projects beyond these even more in the axial direction on one or both sides.

The first flange or the second flange, typically in the region of the first wedge elements, in this case can have a locking screw in each case, which holds the first casing in position when the flange threaded connection is released. This locking screw is preferably accommodated in one of the two flanges in a threaded hole and in the other flange is arranged in a recess with significantly larger diameter than the diameter of the locking screw and with a widened section on the opening side. In this case, a shouldered sleeve (with encompassing flange), which is centrally penetrated by the locking screw, is preferably arranged with radial clearance in the recess and in the widened section.

The shim plates (which can have a thickness which differs between them) typically have a thickness within the range of 0.025-0.5 mm, preferably within the range of 0.05-0.15 mm.

In summary, the radial flange (compressor casing, compressor inlet casing) is preferably equipped with 3 adjustable wedges. 2 wedges (the aforesaid first wedge elements), which are installed on the left and right beneath the parting plane, ensure the vertical alignment of the radial flange. A further wedge (the aforesaid second wedge element), which is installed on the lower part, ensures the lateral, horizontal positioning.

Two additional shouldered sleeves in the case of a locking screw prevent releasing of the flange connection when releasing the flange threaded connection.

For an adjustment, the following working steps are typically required:

Releasing the flange threaded connection. The screws do not have to be removed.

Lifting the compressor casing with a hydraulic tool until the lateral guide wedges are unloaded.

Removing the guide wedges.

Adjusting the guide wedges (correct insertion of the shim plates).

Installing the guide wedges.

Lowering the compressor casing.

Tightening up the flange threaded connection.

Position checking of the radial rotor position.

For displacement in the horizontal direction, the wedge at 6 o'clock is adjusted.

Threaded holes in the lateral wedges can enable a lateral displacement by forcing-off screws or hydraulic tool.

The gas turbine does not have to be opened up in the process.

Further embodiments are disclosed in the dependent claims. All embodiments are applicable both to gas turbines with a compressor, a combustor and a turbine, and for gas turbines with a plurality of compressors and/or a plurality of combustors and/or a plurality of turbines, as are known for example from U.S. Pat. No. 5,402,631 or U.S. Pat. No. 5,634,327, which are incorporated by reference.

DETAILED DESCRIPTION

FIG. 1*a* shows a schematic section through the intake region of the compressor of a gas turbine. The gas turbine 1 has a compressor 2. The compressor has a compressor casing 12 in which the rotor 37 rotates. The rotor 37 has a rotor end 4 which is supported on a bearing support 5 which is typically formed together with the compressor inlet casing 3. The compressor inlet casing 3 in this case encompasses the intake region of the compressor.

Figure 1B:
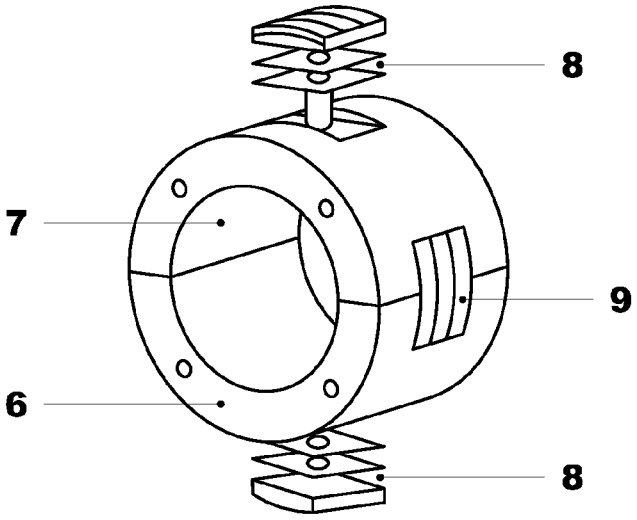
FIG. 1*b*) shows a perspective view of a bearing device for a rotor according to the prior art.

The rotor end 4 is accommodated in the compressor inlet casing 3 in a bearing device 6 which is shown in detail in FIG. 1*b*. The bearing device 6 is arranged in a cavity 10 of the compressor inlet casing 3 and therefore is accessible only with difficulty.

It is significant that the radial rotor position, which is schematically shown by an arrow and identified with the designation 14, is vital for an optimum mode of operation of the compressor. This radial rotor position in the flow region has to be adjusted for example during assembly or after opening up of the gas turbine for maintenance operations or repairs. By adjusting the rotor position, the blade clearance 38 is also adjusted.

According to the usual procedure, this is carried out so that the bearing 6, which is designed specially for such an adjustment, is exposed, the rotor or the rotor end is unloaded, and for vertical adjustment, the shim plates 8 are relocated, and for lateral adjustment the shim plates 9 are relocated.

This procedure is not only costly, because the basically poorly accessible cavity 10 has to be exposed, but is also inconvenient as a result, because these adjustments are possible only if the rotor is lifted. Moreover, such an adjustment necessitates a readjustment of the entire shaft train. This includes adjustment of a coupled generator shaft. In the case of a so-called single-shaft arrangement, this includes adjustment of the gas turbine rotor, of the generator shaft and also even adjustment of a coupled steam turbine shaft.

In FIGS. 2*a*-2*d* it is now shown how such a positioning of the rotor can be significantly simplified. Specifically, it is so that actually only the relative position of rotor 37 to casing 12 in the flow direction has to be adjusted. Accordingly, it is more easily possible to adjust this relative position, specifically by only adjusting the relative position of the casing 12 to that casing section 3 in which provision is made for the bearing arrangement of the rotor.

Figure 2A:
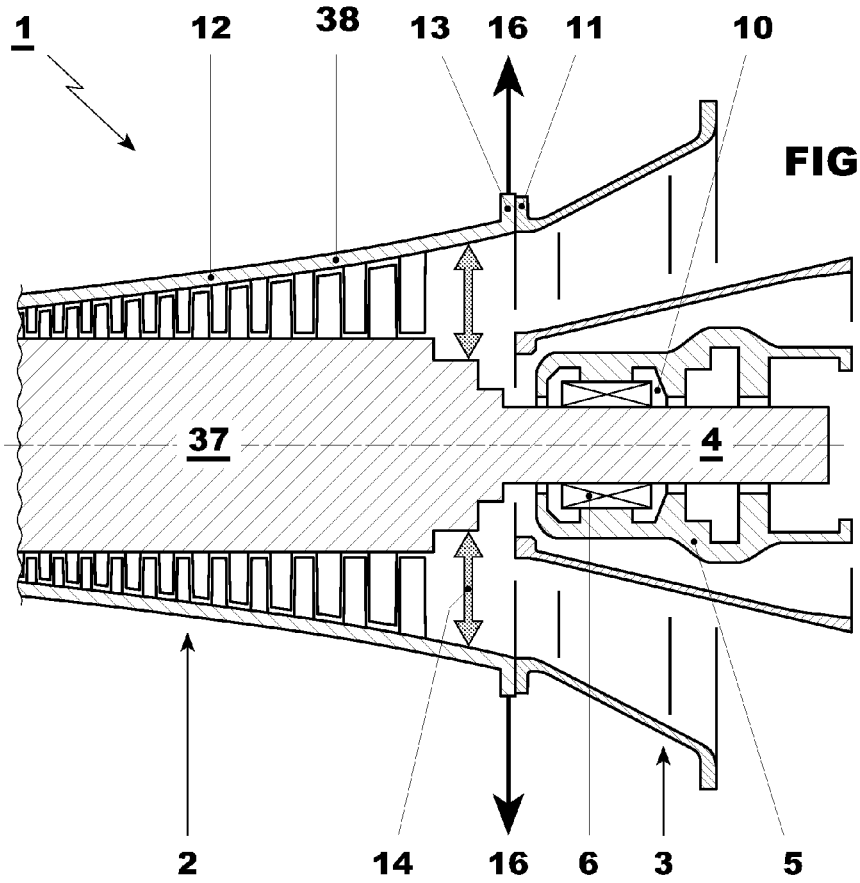
FIG. 2*a*) shows an axial section through the compressor inlet region of a gas turbine with a flange threaded connection according to the invention.
Figure 2B:
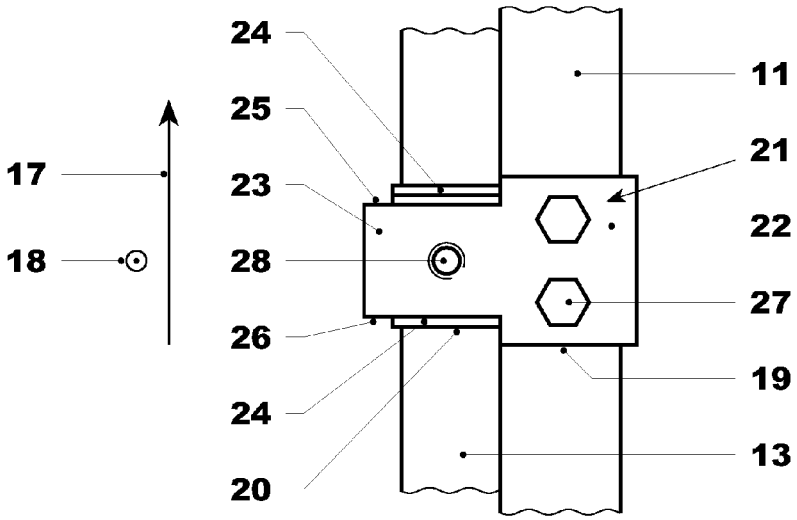
FIG. 2*b*) shows a detail of a side view of the flange threaded connection with a wedge.
Figure 2C:
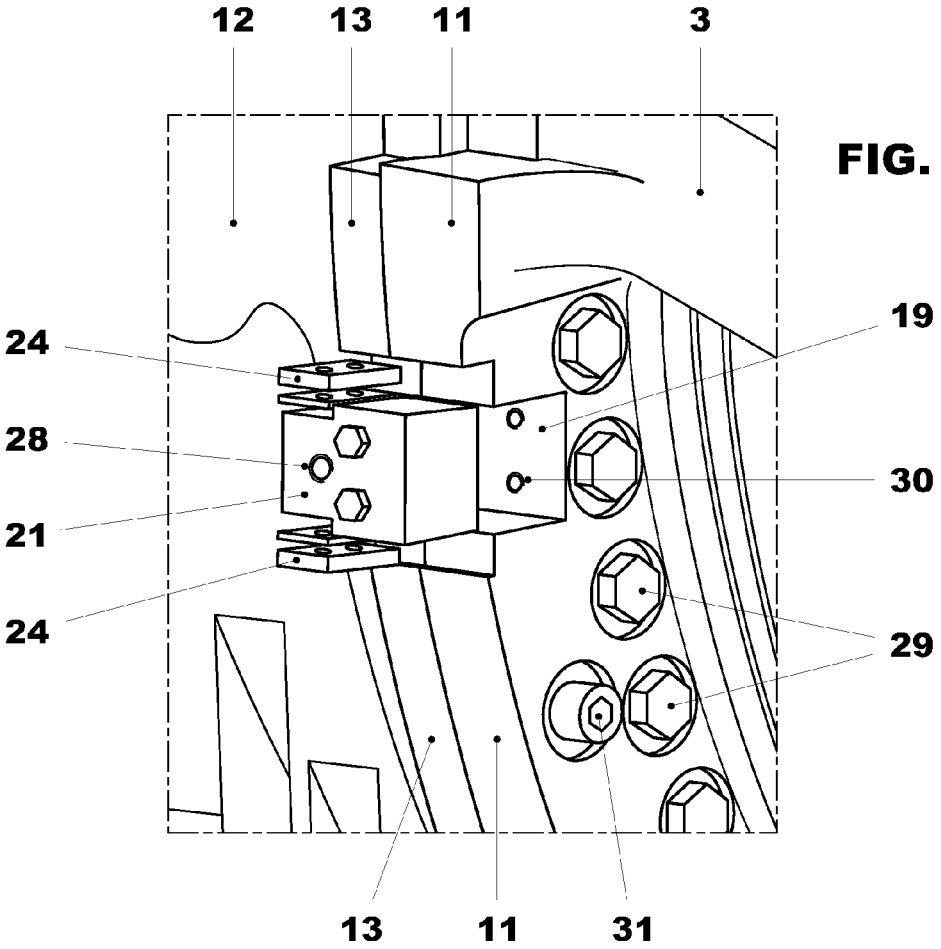
FIG. 2*c*) shows a perspective view of the region of the flange threaded connection with a wedge, wherein the wedge is shown virtually in exploded view, i.e. outside the recesses in the flanges.

In the case of the exemplary embodiment which is shown in FIG. 2*a*, the compressor inlet casing 3 has a radially outwardly extending flange 11 for this purpose. On the other side, the compressor casing 12 also has a flange 13 which extends radially outwards and comes into contact with said flange 11. These two flanges, as can easily be seen particularly in the perspective view according to FIG. 2*c*, are fastened via screws which are arranged with clearance in aligning holes in the two flanges.

In particular, in the case of such a relative fastening of the two casings 3 and 12, it is now possible to provide wedge elements 21. In a side view, such a wedge element is shown in its arrangement in the flanges which are mentioned (FIG. 2*b*). The flange 11 of the compressor inlet casing 3 has an axial recess 19, and, directly opposite, the flange 13 of the compressor casing 12 also has an axial recess 20. The recesses 19 and 20 are essentially in alignment. In this recess, a wedge element 21 is now arranged by it being immovably fixed by a first section 22 in the recess 19, for example with the aid of two screws 27. A second section 23 of this wedge element 21 now extends into the recess 20 in the flange 13 of the compressor casing. This second section 23 has horizontally running upper sides 25 and lower sides 26. These, however, are sufficiently spaced away from the limits of the recess 20 so that a clearance remains in the vertical direction 17 of this section 23.

This clearance is now bridged by means of shim plates 24 which can be arranged on the lower side, on the upper side, or on both sides.

With such a wedge element, which is arranged at the three o'clock position or the nine o'clock position of the flange, or slightly below, it is now possible, if the casing 12 is raised slightly for example with the aid of a hydraulic tool, to withdraw the shim plates 24, to align the position of the casing 12 and therefore of the flange 13 so that the relative position 14 is again optimally adjusted, and then to reinsert the shim plates so that the section 23 is gripped in the recess section 20 of the flange 13 in an essentially form-fitting manner.

Once gripped in this way, however, the casing 12 remains movable in a horizontal direction 18, and is correspondingly fixed in its vertical position, but can now be adjusted in the horizontal direction in a second step.

For this purpose, a further similarly designed wedge is now arranged at the twelve o'clock position and/or at the six o'clock position, the shim plates there are now also removed, adjustment is carried out in the horizontal direction 18, the shim plates are now reinserted in an essentially form-fitting manner, and now, after both the horizontal and the vertical positions have been correctly fixed, the flange threaded connection is tightened up again.

Figure 2D:
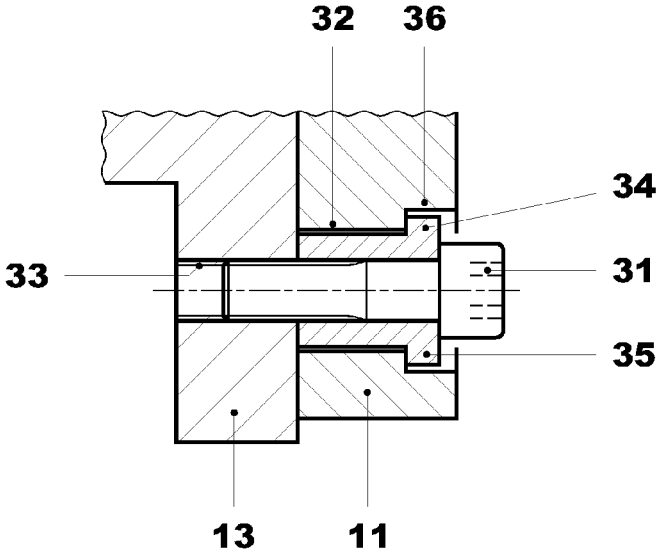
FIG. 2*d*) shows a section through a locking screw of the flange threaded connection.

In order to ensure that upon releasing of the flange threaded connection 29 the casing 12 cannot move too far from the desired position, it is possible to provide a locking screw 31, as is shown in a sectional view in FIG. 2*d*. The locking screw 31 is screwed into a threaded hole 33 in the flange 13. On the other side, provision is made in the flange 11 for a large recess 32 in which is arranged a shouldered sleeve 34 with encompassing flange 35. The encompassing flange in this case is again gripped with clearance in a widened section 36 of the recess 32. For adjustment of the relative position of the casing 12, such a locking screw is correspondingly constructed with a sleeve which has a radial tolerance relative to the locking screw so that the relative position of the casing 12 to the casing 3 can be adjusted for example by means of the hydraulic tool which is in use.

LIST OF DESIGNATIONS

1 Gas turbine
2 Compressor
3 Compressor inlet casing
4 Rotor end
5 Bearing support
6 Bearing of 4
7 Receiving opening in 6 for 4
8 Shims for vertical adjustment of 6
9 Shims for lateral adjustment of 6
10 Cavity in 5 for 6
11 Flange of 3
12 Compressor casing
13 Flange of 12
14 Radial rotor position, rotor relative to casing, measured vertically
15 Vertical adjustment of the rotor position via 6
16 Vertical adjustment of the rotor position via flange connection
17 Vertical direction
18 Horizontal direction
19 Recess in 11
20 Recess in 13
21 Wedge element
22 Section of 21 fastened in 11
23 Section of 21 projecting into 20
24 Shim plate
25 Horizontal upper side of 23
26 Horizontal lower side of 23
27 Fastening screw
28 Threaded hole
29 Screws of flange threaded connection
30 Threaded holes in 11 in 19
31 Locking screw of the flange threaded connection
32 Recess for 31 in 11
33 Female threaded hole in 13 for 31
34 Shouldered sleeve
35 Flange of 34
36 Widened section of 32
37 Rotor
38 Blade clearance

The invention claimed is:

1. A method for adjusting the position of a rotor of a turbine, the turbine comprising a first casing and a second casing wherein the second casing, in a bearing region of the rotor, has a fixed relative position, with regard to a rotor end, and is screwed to the first casing via a threaded connection, the method comprising:

releasing the threaded connection;

adjusting the relative position of the rotor to the first casing, which encloses the rotor in a flow region, by the relative position of the second casing to the first casing being adjusted;

refastening the threaded connection, wherein the relative position of the second casing to the first casing is adjusted via first wedge elements, wherein the first wedge elements fix the position of the first casing in a vertical direction relative to the second casing and allow the position of the first casing to be displaced in a horizontal direction, and the threaded connection is refastened, and wherein at least one second wedge element is provided, the at least one second wedge element fixes the position of the first casing in the horizontal direction relative to the second casing and allows the position of the first casing to be displaced in the horizontal direction, to adjust the position in the horizontal direction, after releasing the threaded connection, the first casing is preferably positioned using a hydraulic tool, and shim plates, which are provided on the sides of the second wedge element, are exchanged.

2. A method for adjusting the position of a rotor of a turbine, the turbine comprising a first casing and a second casing wherein the second casing, in a bearing region of the rotor, has a fixed relative position, with regard to a rotor end, and is screwed to the first casing via a threaded connection, the method comprising:

releasing the threaded connection;

adjusting the relative position of the rotor to the first casing, which encloses the rotor in a flow region, by the relative position of the second casing to the first casing being adjusted;

refastening the threaded connection, wherein the relative position of the second casing to the first casing is adjusted via first wedge elements, wherein the first wedge elements fix the position of the first casing in a vertical direction relative to the second casing and allow the position of the first casing to be displaced in a horizontal direction, and the threaded connection is refastened, and wherein to adjust the position in the vertical direction, after releasing the threaded connection, the first casing is positioned using a hydraulic tool, and shim plates, which are provided on upper and lower sides of the first wedge elements, are exchanged.

3. A turbine, comprising a rotor, which is arranged in a first casing, having a rotor end which is supported in a region of a second casing, the first casing being fastened on the second casing via a threaded connection, wherein in a fastening region of the casings, first wedge elements are provided, which fix the position of the first casing in a vertical direction relative to the second casing and allow the position of the first casing to be displaced in a horizontal direction relative to the rotor when the threaded connection of the two casings is in a released state, and wherein the first casing comprises a radially outwardly oriented first flange, the second casing comprises a radially outwardly oriented second flange, the first casing is fastened on the second casing via the first and second flanges, the first and the second flanges each have axially aligning recesses at 9 o'clock and 3 o'clock positions with regard to a rotational direction of the rotor, and the first wedge elements are arranged in the recesses and bridge the recesses in an axial direction.

4. The turbine as claimed in claim 3, wherein the first wedge elements are configured in the form of blocks with a first section and a second section, the first section is fastened in the recess of the first flange, and the second section has horizontally running upper sides and lower sides, projects into the recess of the second flange, and is arranged with vertical clearance in the recess of the second flange, wherein the clearance is bridged via horizontal shim plates.

5. The turbine as claimed in claim 4, wherein the second section of the first wedge element has at least one horizontal threaded hole which runs radially with regard to the turbine axis, and the relative position of the first casing to the second casing is adjusted via an adjusting screw which is screwed into the threaded hole.

6. The turbine as claimed in claim 3, wherein the first wedge elements are configured in the form of blocks with a first section and a second section, the first section is fastened in the recess of the second flange, and the second section has horizontally running upper sides and lower sides, projects into the recess of the first flange, and is arranged with vertical clearance in the recess of the first flange, wherein this clearance is bridged via horizontal shim plates.

7. The turbine as claimed in claim 6, wherein the second section of the first wedge element has at least one horizontal threaded hole which runs radially with regard to the turbine axis, and the relative position of the first casing to the second casing is adjusted via an adjusting screw which is screwed into the threaded hole.

8. The turbine as claimed in claim 6, wherein the shim plates have a thickness between 0.025-0.5 mm.

9. The turbine as claimed in claim 6, wherein the shim plates have a thickness between 0.05-0.15 mm.

10. The turbine as claimed in claim 3, further comprising at least one second wedge element which fixes the position of the first casing in the horizontal direction relative to the second casing and allows the position of the first casing to be displaced in the vertical direction, when the threaded connection of the two casings is in the released state, wherein the at least one second wedge element is arranged at 12 o'clock or 6 o'clock positions with regard to the rotational direction of the rotor.

11. The turbine as claimed in claim 10, wherein the first wedge element and/or the at least one second wedge element have a length in the axial direction which lies at least within the range of an overall thickness of the two flanges.

12. The turbine as claimed in claim 3, wherein the first flange or the second flange, in the region of the first wedge elements, has a locking screw which holds the first casing in position when the threaded connection is released, the locking screw is accommodated in a threaded hole in the first or second flange and is arranged in the other flange in a recess with a widened section on the opening side, wherein a shouldered sleeve, which is centrally penetrated by the locking screw, is arranged with clearance in the recess and in the widened section.

* * * * *